US008398436B2

(12) United States Patent
Fischer et al.

(10) Patent No.: US 8,398,436 B2
(45) Date of Patent: Mar. 19, 2013

(54) STACKABLE CABLE MOUNT POWER CONNECTOR

(75) Inventors: Charles P. Fischer, Marlton, NJ (US); Jack S. Bush, Pennsville, NJ (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 12/920,414

(22) PCT Filed: Nov. 16, 2009

(86) PCT No.: PCT/US2009/064525

§ 371 (c)(1), (2), (4) Date: Sep. 7, 2010

(87) PCT Pub. No.: WO2011/059452

PCT Pub. Date: May 19, 2011

(65) Prior Publication Data

US 2012/0220166 A1 Aug. 30, 2012

(51) Int. Cl.
*H01R 24/00* (2011.01)

(52) U.S. Cl. ..... 439/626; 439/540.1

(58) Field of Classification Search ..... 439/21, 439/22, 27, 540.1, 626, 638, 639, 650–654
See application file for complete search history.

(56) References Cited

U.S. PATENT DOCUMENTS 3,043,925 A 7/1962 Wilson
3,843,853 A * 10/1974 Panek et al. ..... 200/51.09
4,264,115 A * 4/1981 Chow ..... 439/180
4,684,190 A * 8/1987 Clark et al. ..... 439/587
5,551,882 A 9/1996 Whiteman, Jr. et al.

* cited by examiner

*Primary Examiner* — Khiem Nguyen
(74) *Attorney, Agent, or Firm* — King & Spalding LLP

(57) ABSTRACT

A stackable cable mount power connector includes a cover having a draw screw engagement pin and a connector shell having a bushing and an insert assembly positioned therein. A draw screw having a locking pin is positioned within the bushing. The bushing includes grooves for receiving the locking pin. The connector includes multiple primary contact pins having an upper portion and a lower portion. The upper portion of the primary contact pins is positioned within the bushing. The lower portion of the primary contact pins is positioned within the insert assembly. The upper portion of the primary contact pins is configured to receive secondary contact pins. The lower portion of the primary contact pins is configured to engage a power source. The connector also includes a stud positioned within the insert assembly. The stud includes slots for receiving the locking pin. When the cover is removed from the connector shell, the locking pin is positioned within the grooves of the bushing, and the draw screw is fixed within the connector and does not rotate. When the cover is attached to the connector shell, the draw screw engagement pin engages the draw screw, and can be rotated by a handle attached thereto. Attachment of the cover causes the locking pin to be positioned within the slots in the stud, and the draw screw is rotatable within the connector, thus allowing connection to a power source. The cover can be removed to allow a secondary connector to be coupled to the bushing.

20 Claims, 14 Drawing Sheets

STACKABLE CABLE MOUNT POWER CONNECTOR

TECHNICAL FIELD

The present invention relates generally to cable connector systems. More particularly, the present invention is directed to a stackable cable mount power connector for connecting multiple power cables to a single power source.

BACKGROUND OF THE INVENTION

Connectors are typically used to join a length of cable to a power source. Such connectors may be used in military applications, shipboard, for ground support, in airborne applications, in commercial industrial equipment and instrumentation, and other harsh environments. For example, military missions typically require the use of multiple radios for interoperable and tactical communications. Each radio is generally powered by a length of cable joined to a connector that is coupled to a power source. Conventional connectors allow for a single cable to be coupled to a power source. As a result, a different power source is needed for each radio. The use of multiple power sources for multiple cables in a single area results in wasted space and increased costs.

Therefore, a need exists for an improved connector system that allows multiple power cables to be coupled to a single power source where the power source carries sufficient current (amperage) to support additional units.

SUMMARY OF THE INVENTION

The present invention satisfies the above-described need by providing primary connector systems that allow secondary connector systems to be coupled thereto. Thus, multiple power cables can be joined to a single power source.

In one embodiment, connectors of the present invention include a connector shell having a first cavity and a second cavity. A molded-in bushing is positioned within the first cavity. The bushing includes a central opening and primary upper pin apertures. Primary contact pins are also included in the connector. The primary contact pins have an upper portion and a lower portion. The upper portions of the primary contact pins are positioned within the primary upper pin apertures. The upper portion also includes a cavity for receiving secondary contact pins from a secondary connector. The connector also includes a draw screw is positioned within the central opening of the bushing. In certain aspects, the draw screw includes a locking pin extending orthogonally from a central shaft. The bushing includes multiple grooves for receiving the locking pin. The draw screw is unable to rotate when the locking pin is positioned within the grooves in the bushing. The connector also includes nosepiece positioned within the first cavity and separated by a distance from the bushing. The nosepiece includes an insert assembly therein. The insert assembly includes a stud aperture and multiple primary lower pin apertures. The lower portion of the primary contact pins is positioned in the primary lower pin apertures, and a stud is positioned within the stud aperture. The stud includes an upper stud portion having at least one slot for receiving the locking pin. When the locking pin is positioned within the slot in the stud, the draw screw and the stud are rotatable within the connector. In certain aspects, the connector also includes a spring member positioned around the upper stud portion. When the spring is in a decompressed state, the spring member biases the locking pin into one of the grooves in the bushing. When the spring is in a compressed state, the locking pin is positioned within the slot in the stud. In certain aspects, a cover is removably coupled to the end of the shell having the bushing. The cover includes a draw screw engagement pin that is in communication with a handle. The draw screw engagement pin engages the draw screw, and when the handle is rotated, the draw screw engagement pin and the draw screw also rotate. The connector further includes a cable positioned in the second cavity. The cable is in electrical contact with the primary contact pins.

In another embodiment, connector systems of the present invention include a shell housing having a first cavity and a second cavity. The first cavity includes an upper shell portion and a lower shell portion. An electrical cable is disposed within the second cavity. A molded-in bushing is positioned within the upper shell portion of the first cavity. The bushing includes a draw screw opening, a primary upper pin apertures, and a means for engaging a draw screw. In certain aspects, the means for engaging the draw screw includes grooves about an end of the draw screw opening. A draw screw is positioned in the draw screw opening of the bushing and includes a locking means. In certain aspects, the locking means is a locking pin. The connector system also includes an insert assembly positioned within the lower shell portion of the first cavity. The insert assembly includes a stud aperture and primary lower pin apertures. A stud is positioned in the stud aperture. The stud includes an upper stud portion and a lower stud portion, where the upper stud portion has a receiving means for receiving the locking means. In certain aspects, the receiving means is one or more slots. The connector system also includes primary contact pins. The primary contact pins are in electrical contact with the cable. Each primary contact pin has an upper portion and a lower portion, where the upper portion is positioned within a primary upper pin aperture. The upper portion also includes a pin cavity for receiving a secondary contact pin. The lower portion of each primary contact pin extends through a primary lower pin aperture. A spring member is disposed around the upper stud portion and biases the locking means towards the means for engaging a draw screw. Upon compression of the spring member, the locking means is positioned within the receiving means and the draw screw and the stud are rotatable within the connector system, thus allowing for coupling of the primary connector system. In certain aspects, a cover is removably coupled to the shell housing adjacent the first cavity. The cover includes a draw screw engagement pin that engages the draw screw and compresses the spring member.

These and other aspects, objects, features, and embodiments of the present invention will become apparent to those having ordinary skill in the art upon consideration of the following detailed description of illustrative embodiments exemplifying the best mode for carrying out the invention as presently perceived.

DETAILED DESCRIPTION OF THE INVENTION

Figure 1A:
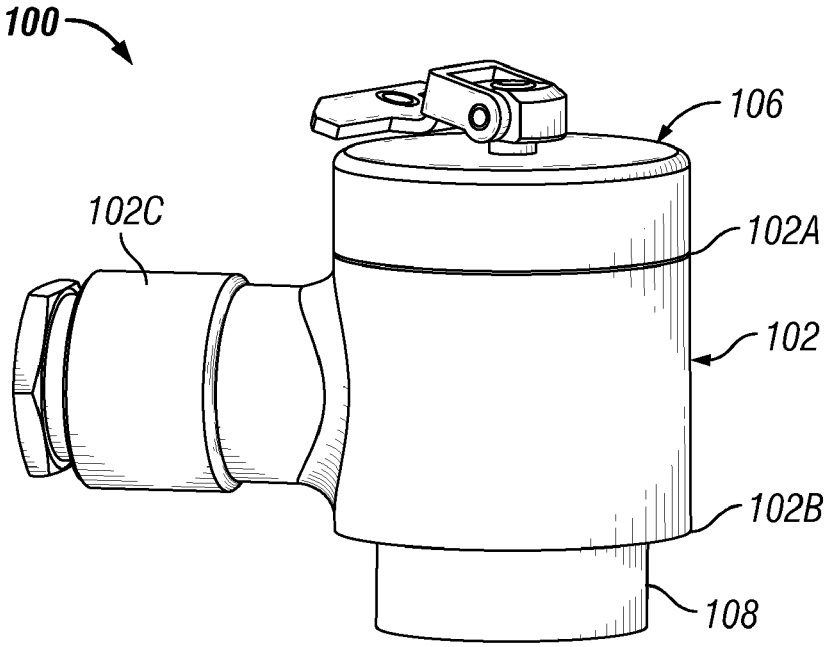
FIG. 1A is a perspective view of a stackable cable mount power connector, according to an exemplary embodiment.

A stackable cable mount power connector described herein allows multiple power cables to be coupled to a single power source. The connector is generally resistant to the effects of shock and vibration, and capable of withstanding the extreme range of environmental conditions encountered by ground support equipment. The connector also offers versatile configurations for virtually any military or industrial need.

The invention may be better understood by reading the following description of non-limitative, exemplary embodiments with reference to the attached drawings wherein like parts of each of the figures are identified by the same reference characters.

FIG. 1A is a perspective view of a stackable cable mount power connector 100, showing components visible from an exterior, according to an exemplary embodiment. The connector 100 includes a connector shell 102 having an upper end 102*a*, a lower end 102*b*, and an extension 102*c*. In certain exemplary embodiments, the connector 100 includes an environmental dust cover, or cap 106 that is coupled to the upper end 102*a* of the connector shell 102. The connector 100 also includes a cylindrical nosepiece 108 extending from the lower end 102*b* of the connector shell 102. The nosepiece 108 has a diameter that is less than a diameter of the connector shell 102, and is at least partially positioned within the connector shell 102. The nosepiece 108 of the connector 100 is configured to mate with a power source 1090 (FIGS. 10A-10D). The extension 102*c* is configured to receive an end of a cable (not shown) therein. The cable is coupled to a device, such as a radio, to be powered. Once the nosepiece 108 of the connector 100 is coupled to the power source 1090, power is supplied through the cable attached to the connector 100, to the device to be powered. The cap 106 can then be removed to allow a user to couple a secondary connector 1080 (FIGS. 10A-10D) to the upper end 102*a* of the connector 100. The secondary connector 1080 is coupled to another cable (not shown) to supply power to another device, such as a radio. Once the secondary connector 1080 is coupled to the connector 100, power is supplied through the connector 100, to the secondary connector 1080, through the cable attached to the secondary connector 1080, and to the device to be powered. As a result, two devices can be powered at the same time by a single power source 1090.

In certain exemplary embodiments, the connector shell 102, the cap 106, and the nosepiece 108 are constructed from any material that meets the requirements dictated by the operating environment. In certain embodiments, the connector shell 102 is constructed from aluminum. In certain embodiments, the nosepiece 108 is constructed from heat treated steel. In certain embodiments, the cap 106 is constructed from aluminum.

Figure 1B:
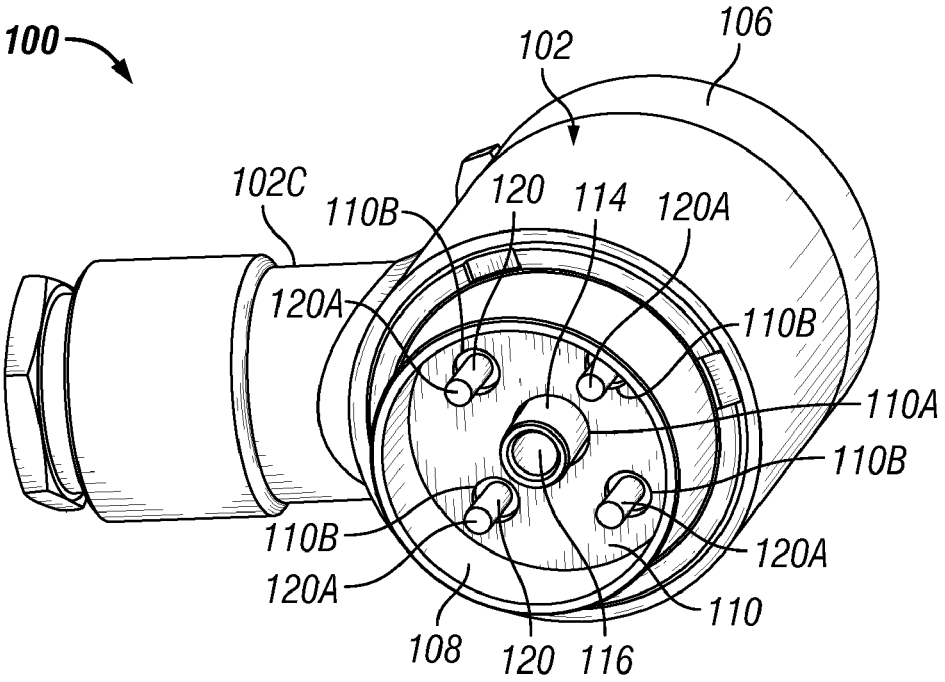
FIG. 1B is a bottom perspective view of the connector of FIG. 1A, according to an exemplary embodiment.

FIG. 1B is a bottom perspective view of the connector 100, showing components housed within the nosepiece 108 that are visible from an exterior, according to an exemplary embodiment. The components in the nosepiece 108 are configured to be coupled to a power source 1090 (FIGS. 10A-10D). The components include an insert assembly 110 housing a stud 114 and four contact pins 120. The insert assembly 110 is positioned within the nosepiece 108, and is recessed therein. The insert assembly 110 includes a central aperture 110*a* and four pin apertures 110*b* positioned about the central aperture 110*a*. The cylindrical stud 114 is positioned within the central aperture 110*a* and extends out from the insert assembly 110. The stud 114 includes female threads 116 on an interior thereof. The stud 114 is configured to receive a screw 1096 when coupled to the power source 1090. Each contact pin 120 is positioned within one of the pin apertures 110*b*. A lower portion 120*a* of the contact pin 120 extends out from the insert assembly 110 and is configured to mate with the power source 1090. When coupled to the power source 1090, the contact pins 120 provide an electrical interface between the power source 1090 and a cable (not shown) positioned in the extension 102*c*.

In certain exemplary embodiments, the contact pins 120 are constructed from brass. In certain exemplary embodiments, the contact pins 120 are gold-plated. In alternative embodiments, the contact pins 120 are constructed from any non-ferrous, conductive material such as copper, brass, phosphor bronze, beryllium cooper, and the like. In certain alternative embodiments, the insert assembly 110 may include more than four pin apertures 110*b* to accommodate a greater number of contact pins 120. For example, in certain exemplary embodiments, the insert assembly 110 may include eighteen pin apertures 110*b* that are configured in two concentric circles of nine pin apertures 110*b* about the central aperture 110*a*, each pin aperture 110*b* housing a contact pin 120. In certain embodiments, such as in commercial and industrial applications, a variety of contact patterns could be utilized to provide signal or power connections. As a result, the connector 100 offers any number of configurations for virtually any military or industrial need.

Figure 1C:
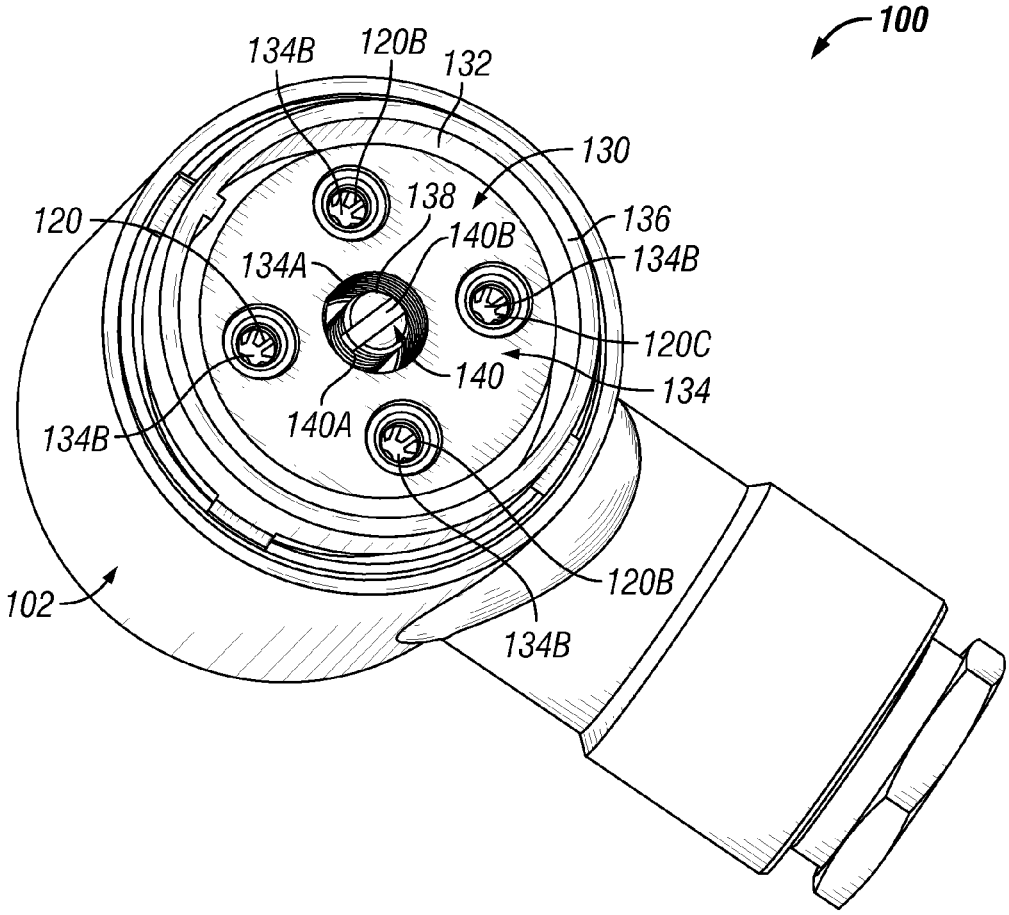
FIG. 1C is a top perspective view of the connector of FIG. 1A, with the cap removed, according to an exemplary embodiment.

FIG. 1C is a top perspective view of the connector 100, with the cap 106 removed, showing components housed within the connector shell 102 that are visible from an exterior, according to an exemplary embodiment. The components seen are configured to mate with the cap 106 (FIG. 1A) or a secondary connector 1080 (FIGS. 10A-10D). The connector 100 includes a molded-in bushing 130 positioned within the connector shell 102. The bushing 130 includes a cylindrical recess 132 defining a center portion 134. The recess 132 is positioned between an outer wall 136 of the bushing 130 and the center portion 134. The recess 132 is configured to receive a nosepiece 1082 (FIGS. 10A-10B) of a secondary connector 1080 therein when coupled to the secondary connector 1080. The center portion 134 of the bushing 130 includes a central aperture 134*a* and four pin apertures 134*b* positioned about the central aperture 134*a*. The central aperture 134*a* includes female threads 138 on the upper end of the interior thereof. The central aperture 134*a* is configured to mate with corresponding male threads 106*d* on a male projection 106*c* (FIG. 1D) of the cap 106 when coupled to the cap 106. A draw screw 140 is positioned within the central aperture 134*a*. The draw screw 140 includes a groove 140*b* configured to engage a protrusion 150*c* of a draw screw engagement pin 150 (FIG. 1D) in the cap 106. The draw screw 140 also includes male threads 140*a* and is configured to mate with female threads 1086*a* of a cylindrical stud 1086 in a secondary connector 1080 (FIGS. 10A-10D). An upper portion 120*b* of the contact pins 120 are positioned within each of the pin apertures 134*b*. The upper portion 120*b* of the contact pins 120 includes an opening 120*c* configured to receive contact pins 1084 of the secondary connector 1080 when coupled to the secondary connector 1080. In certain alternative embodiments, the center portion 134 of the bushing 130 may include more than four pin apertures 134*b* to accommodate a greater number of contact pins 120.

Figure 1D:
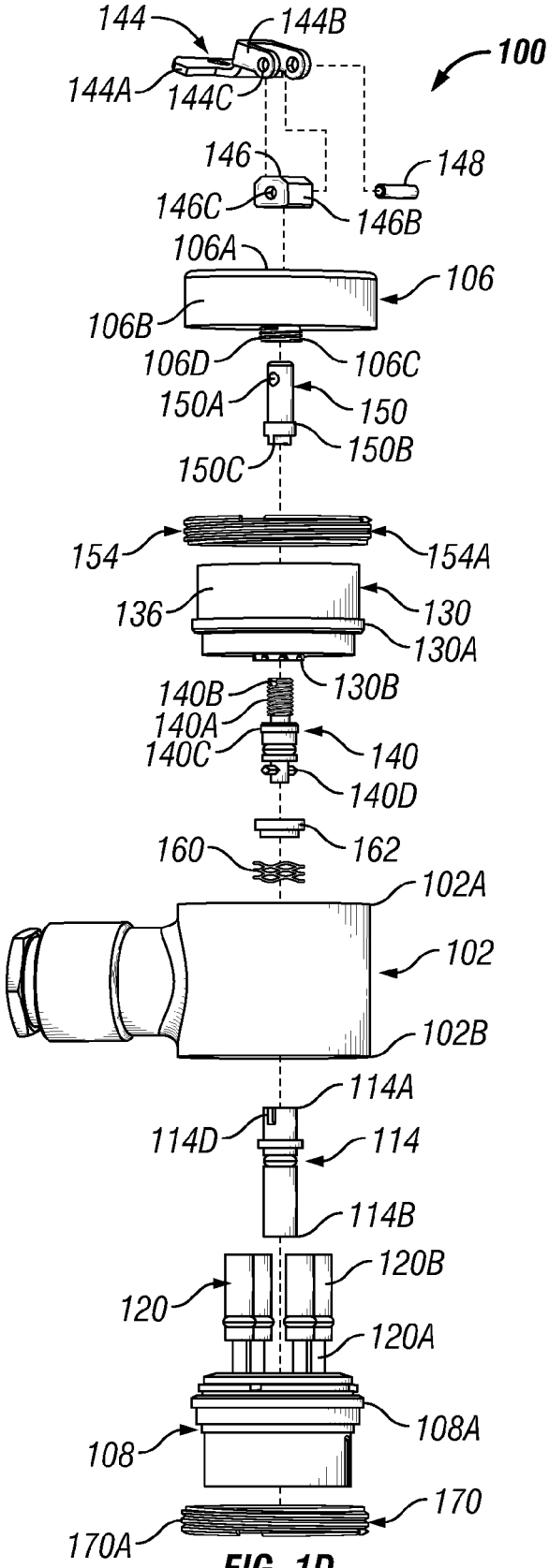
FIG. 1D is an exploded view showing the primary components of the connector of FIG. 1A, according to an exemplary embodiment.
Figure 1E:
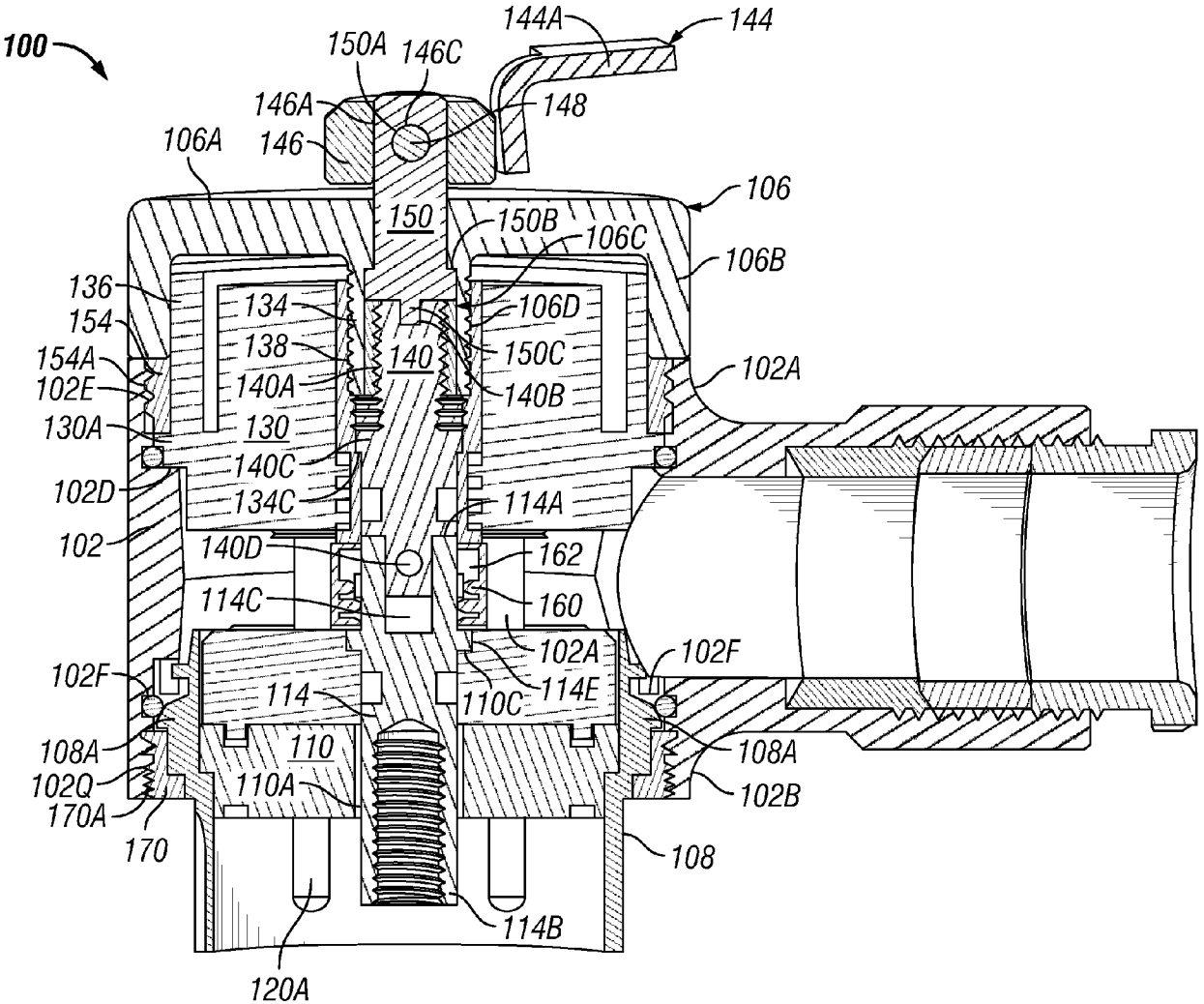
FIG. 1E is a side cross-sectional view of the connector of FIG. 1A, according to an exemplary embodiment.
Figure 1F:
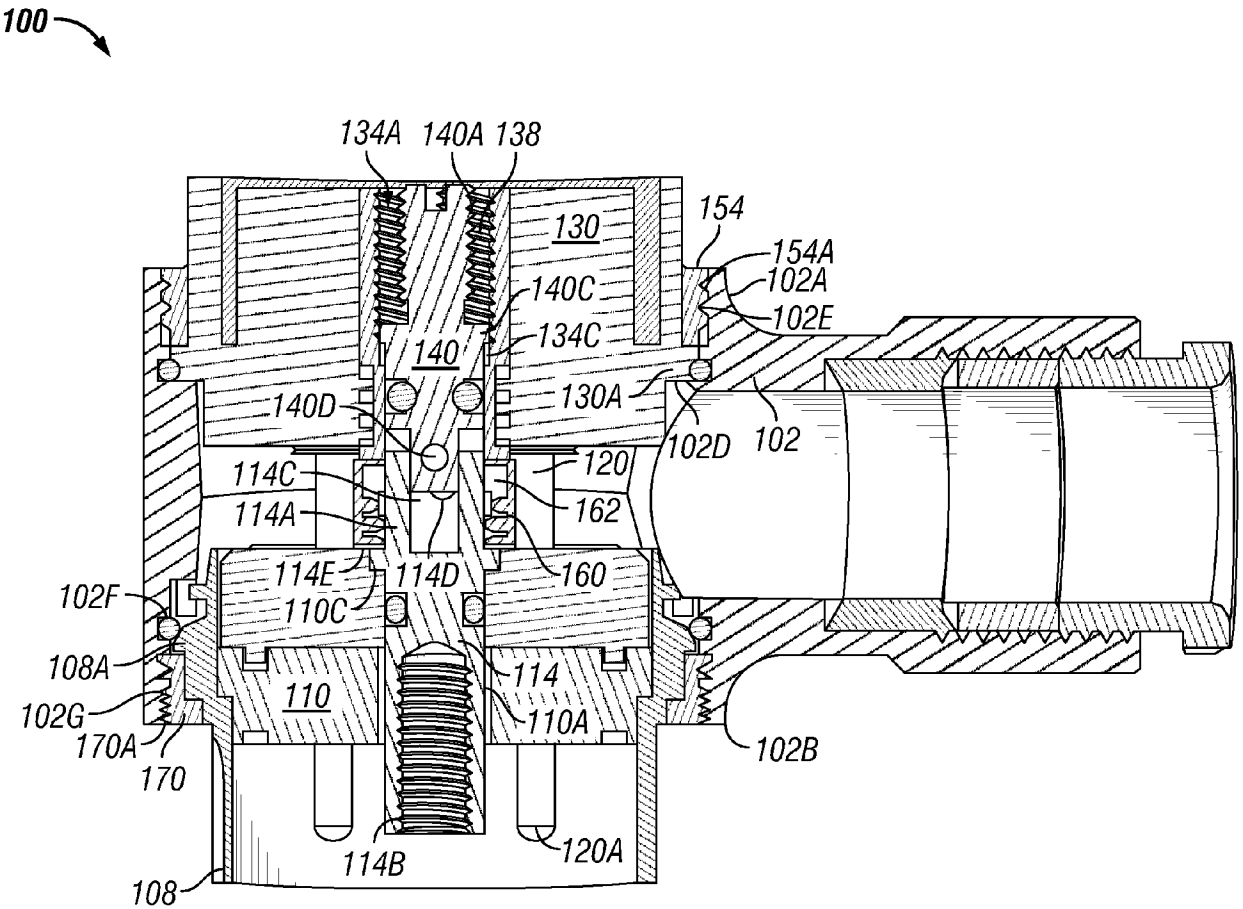
FIG. 1F is a side cross-sectional view of the connector of FIG. 1A, with the cap removed, according to an exemplary embodiment.

FIG. 1D is an exploded view showing all of the components of the connector 100, FIG. 1E is a side cross-sectional view of the assembled connector 100, and FIG. 1F is a side cross-sectional view of the assembled connector 100 with the cap 106 removed, according to an exemplary embodiment. Referring to FIGS. 1D-1E, the connector 100 includes the cap 106 having a base 106*a*, a side wall 106*b* extending from the base 106*a*, and a hollow cylindrical projection 106*c* extending from a center of the base 106*a* in the same direction as the side wall 106*b*. The side wall 106*b* is configured to surround the outer wall 136 of the bushing 130 when the cap 106 is coupled to the connector 100. The projection 106*c* includes male threads 106*d* for mating with threads 138 of the bushing 130. The cap 106 also includes a handle 144, a pin receiver 146, a connecting rod 148, and a draw screw engagement pin 150. The handle 144 includes a base 144*a* from which two coupling extensions 144*b* extend. Each of the coupling extensions 144*b* includes an opening 144*c* therein. Each of the openings 144*b* are configured to receive the connecting rod 148. The pin receiver 146 includes a central opening 146*a* configured to receive the draw screw engagement pin 150. The pin receiver 146 also includes two flat side surfaces 146*b* that are flush with the extensions 144*b* of the handle 144 upon assembly. The pin receiver 146 includes an opening 146*c* extending through the pin receiver 146 from one flat side surface 146*b* to the other. The opening 146*c* is configured to receive the connecting rod 148. The draw screw engagement pin 150 also includes an opening 150*a* configured to receive the connecting rod 148.

Upon assembly of the cap 106, the pin receiver 146 is positioned on the base 106*a* of the cap such that central opening 146*a* of the pin receiver 146 is aligned with the projection 106*c* of the cap 106. The draw screw engagement pin 150 is positioned within the central opening 146*a* of the pin receiver 146 and at least partially within the projection 106*c*. The draw screw engagement pin 150 is positioned within the central opening 146*a* such that the opening 150*a* is aligned with the opening 146*c* of the pin receiver 146. The handle 144 is coupled to the pin receiver 146 such that each of the openings 144*c* of the handle 144 are aligned with the opening 146*c* of the pin receiver 146. The connecting rod 148 is then positioned within the openings 144*c*, 146*c*, and 150*a* to secure the handle 144, the pin receiver 146, and the draw screw engagement pin 150 together. The draw screw engagement pin 150 also includes a ledge 150*b* for holding the draw screw engagement pin 150 in place within the projection 106*c*. Once assembled, rotation of the handle 144 causes the draw screw engagement pin 150 to also rotate. In certain exemplary embodiments, the draw screw engagement pin 150 includes a protrusion 150*c* configured to engage the groove 140*b* of the draw screw 140. Rotation of the draw screw engagement pin 150, and subsequently the protrusion 150*c*, would cause the draw screw 140 to also rotate.

Referring now to FIGS. 1D-1F, the bushing 130 is positioned within the connector shell 102 and extends at least partially out of the upper end 102*a* of the connector shell 102. The bushing 130 includes a protrusion 130*a* that rests upon a ledge 102*d* within the connector shell 102. The bushing 130 is locked in place by a spanner nut 154 surrounding the bushing 130 and positioned on a side of the protrusion 130*a* opposite the ledge 102*d*. The spanner nut 154 includes male threads 154*a* configured to mate with female threads 102*e* on an interior of the upper end 102*a* of the connector shell 102, thus securing the protrusion 130*a* between the spanner nut 154 and the ledge 102*d*.

The draw screw 140 is positioned within the central aperture 134*a* of the bushing 130 such that the threads 140*a* are positioned in the upper end of the central aperture 134*a*. The draw screw 140 includes a protrusion 140*c* at a position below the threads 140*a*. The central aperture 134*a* of the bushing 130 includes a ledge 134*c* on which the protrusion 140*c* rests when the cap 106 is secured (FIG. 1E). The ledge 134*c* functions as a positional stop for the draw screw 140. The bushing 130 includes multiple grooves 130*b* (FIG. 1D) spaced apart about the central aperture 134*a* on an end opposite the female threads 138. The grooves 130*b* are configured to receive a pin 140*d* that protrudes from the draw screw 140. At least two grooves 130*b* positioned opposite one another receive the pin 140*d* when the cap 106 is removed (FIG. 1F), and the draw screw 140 is unable to turn in this condition, described in further detail below. When the cap 106 is removed, the protrusion 140*c* of the draw screw 140 also disengages the ledge 134*c*. When the cap 106 is secured, the pin 140*d* shifts into slots 114*d* in the stud 114 and disengages the grooves 130*b* of the bushing 130, and the draw screw 140 can rotate within the central aperture 134*a*.

The connector 100 also includes a spring member 160 and a nylon spacer 162. The nylon spacer 162 is positioned around the draw screw 140 adjacent to and below the pin 140*d*. The spring member 160 is in contact with the nylon spacer 162 on a side opposite the side that the pin 104*d* contacts. The spring member 160 is held in place by the nylon spacer 162 and the stud 114 and/or the insert assembly 110. Referring to FIG. 1E, when the cap 106 is secured, the draw screw engagement pin 150 engages the draw screw 140 and shifts the draw screw 140 downwards towards the nylon spacer 162. The pin 140*d* disengages the grooves 130*b* of the bushing 130 and shifts into the slots 114*d* in the stud 114 as the draw screw 140 shifts downwards. The pin 140*d* also shifts the nylon spacer 162 downwards, and the nylon spacer 162 compresses the spring member 160. Referring now to FIG. 1F, when the cap 106 is removed, the draw screw engagement pin 150 disengages the draw screw 140. The spring member 160 decompresses and biases the nylon spacer 162 upwards. The nylon spacer 162 forces the pin 140*d* to also shift upwards and engage the grooves 130*b* of the bushing 130. Once the pin 140*d* is positioned within the grooves 130*b*, the draw screw 140 is locked in place and is unable to rotate within the central aperture 134*a*.

Referring again to FIGS. 1D-1F, the nosepiece 108 is at least partially positioned within the connector shell 102. A portion of the nosepiece 108 extends out from the lower end 102*b* of the connector shell 102. The nosepiece 108 includes a protrusion 108*a* that rests against a ledge 102*f* within the connector shell 102. The nosepiece 108 is locked in place by a spanner nut 170 surrounding the nosepiece 108 and positioned on a side of the protrusion 108*a* opposite the ledge 102*f*. The spanner nut 170 includes male threads 170*a* configured to mate with female threads 102*g* on an interior of the lower end 102*b* of the connector shell 102, thus securing the protrusion 108*a* between the spanner nut 170 and the ledge 102*f*.

The insert assembly 110 is positioned and secured within the nosepiece 108. The insert assembly 110 includes the central aperture 110*a* and four pin apertures 110*b* (FIG. 1B) positioned about the central aperture 110*a*. The cylindrical stud 114 is rotatably positioned within the central aperture 110*a*. The stud 114 includes an upper end 114*a* and a lower end 114*b*. The lower end 114*b* is configured to receive a screw 1096 of a power source 1090 (FIGS. 10A-10D) and extends out from the insert assembly 110. The upper end 114*a* of the stud 114 includes an opening 114*c* and two slots 114*d* configured to receive the pin 140*d* and the lower portion of the draw screw 140 in which the pin 140*d* sits. When the cap 106 is secured (FIG. 1E), the pin 140*d* is positioned within the slots 114*d* of the stud 114, and the stud 114 can rotate upon rotation of the draw screw 140. When the cap 106 is removed (FIG. 1F), the pin 140*d* exits the slots 114*d*, and the stud 114 does not rotate. In certain exemplary embodiments, the stud 114 includes a protrusion 114*e* that is secured between the spring member 160 and a ledge 110*c* in the insert assembly 110.

The upper portion 120*b* of each of the contact pins 120 is positioned within each of the pin apertures 134*b* of the bushing 130. The lower portion 120*a* of each of the contact pins 120 extends through and out of the insert assembly 110. The bushing 130 and the insert assembly 110 are separated by a distance within the connector shell 102 such that sufficient space is provide for cable wire terminations and a portion of the contacts 120 is exposed. The terminations are accomplished by wire wrapping the conductors "J-Hook" style around the exposed portions of the contacts 120, and soldering into position.

Figure 2:
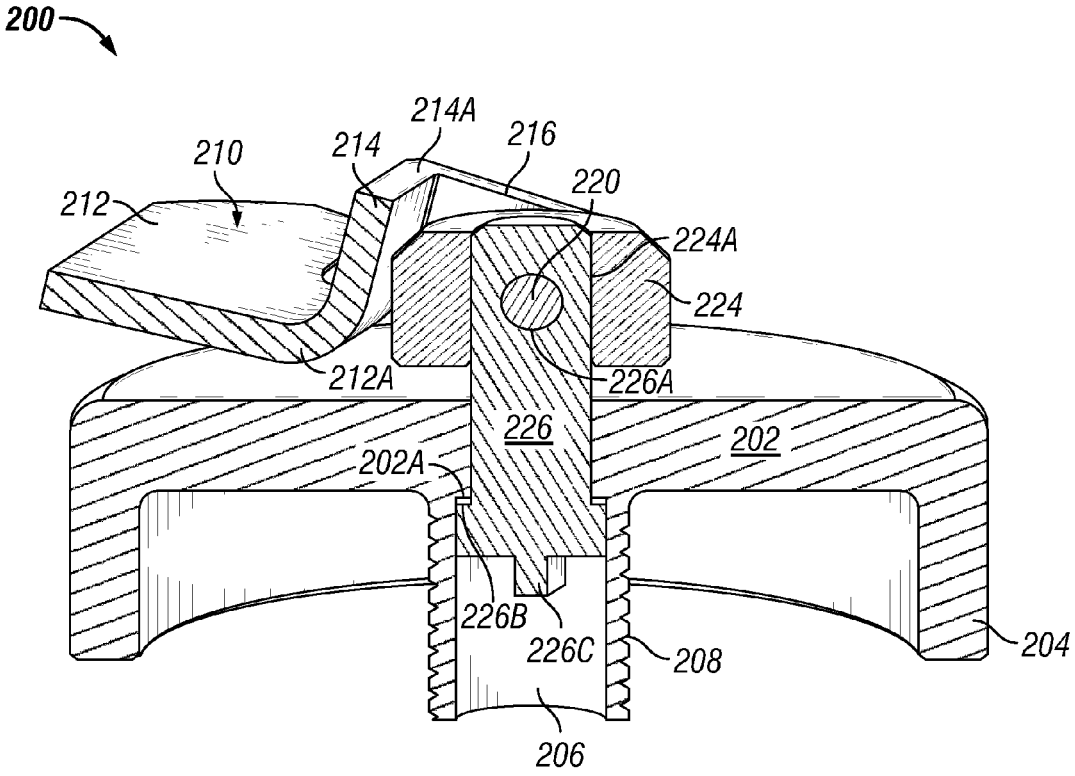
FIG. 2 is a side cross-sectional view of a cap, according to an exemplary embodiment.

FIG. 2 is a side cross-sectional view of a cap 200, according to an exemplary embodiment. The cap 200 provides an environmental dust cover for the connector 100 (FIG. 1C). The cap 200 includes a circular disk-shaped base 202, a cylindrical side wall 204 extending from the base 202, and a hollow cylindrical projection 206 extending from a center of the base 202 in the same direction as the side wall 204. The side wall 204 has a substantially smooth interior surface. In alternative embodiments, the side wall 204 may include threads. The projection 206 includes male threads 208 for mating with female threads 314 in a central aperture 310 of a bushing 300 (FIG. 3). Thus, when the cap 200 is secured to a connector 100, the cap 200 prevents dust and other environmental particles from entering the interior of the connector 100.

The cap 200 also includes features that allow the connector 100 to be coupled to a power source 1090 (FIGS. 10A-10D). These features include a handle 210, a pin receiver 224, and a draw screw engagement pin 226. The handle 210 includes a flat base 212 that can readily be grasped by a user. A middle base 214 extends orthogonally from an end 212*a*. base 212. A coupling extension 216 extends orthogonally from each side 214*a* of the middle base 214 in a direction away from the flat base 212. Each coupling extension 216 includes an opening (not shown) configured to receive a connecting rod 220. The pin receiver 224 includes a cylindrical central opening 224*a* configured to receive the draw screw engagement pin 226. The pin receiver 224 is positioned on the base 202 of the cap 200 such that the cylindrical central opening 224*a* is aligned with the projection 206. The pin receiver 224 also includes two flat side surfaces (not shown) that are flush with the extensions 216 of the handle 210 upon assembly. The pin receiver 224 includes a rod opening (not shown) extending through the pin receiver 224 from one flat side surface (not shown), through the cylindrical central opening 224*a*, to the other flat surface (not shown). The rod opening is configured to receive the connecting rod 220. The draw screw engagement pin 226 also includes an opening 226*a* configured to receive the connecting rod 220 when the draw screw engagement pin 226 is positioned within the cylindrical central opening 224*a* of the pin receiver 224. The draw screw engagement pin 226 is also partially positioned the projection 206. The draw screw engagement pin 226 also includes a protrusion 226*b* that rests against a ledge 202*a* and holds the draw screw engagement pin 226 in place within the projection 206. The draw screw engagement pin 226 includes a protrusion 226*c* configured to engage a groove 410 in a draw screw 400 (FIG. 4).

The handle 210 can pivot about the connecting rod such that the flat base 212 is parallel to the base 202 of the cap 200, the flat base 212 is perpendicular to the base 202, or any position in between. The handle 210 can also rotate about a center of the base 202 of the cap 200. When the cap 200 is not in use, the handle 210 is positioned such that the flat base 212 is parallel to the base 202, thus preventing accidental rotation of the handle 210. When a user wishes to secure or remove the cap 200 from a connector 100, the user pivots the handle 210 such that the flat base 212 is perpendicular to the base 202, and the user is then able to grasp the flat base 212 and rotate it. As the handle 210 is rotatably coupled to the pin receiver 224 and the draw screw engagement pin 226 by the connecting rod 220, rotation of the handle 210 causes the draw screw engagement pin 226, and subsequently the protrusion 226*c*, to also rotate.

Figure 3A:
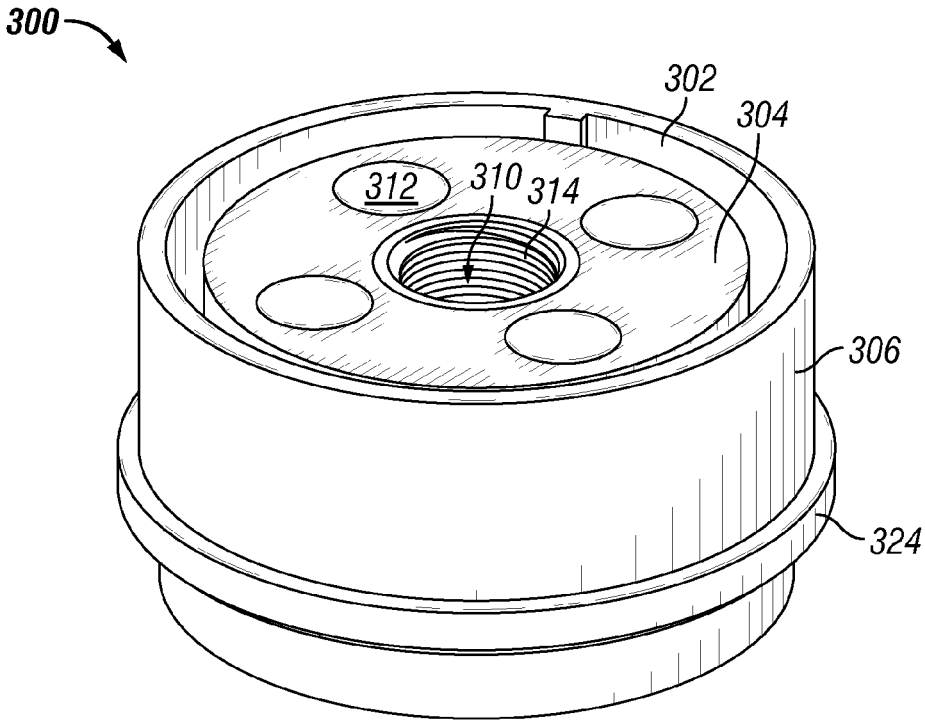
FIG. 3A is a perspective view of a molded-in bushing, according to an exemplary embodiment.
Figure 3B:
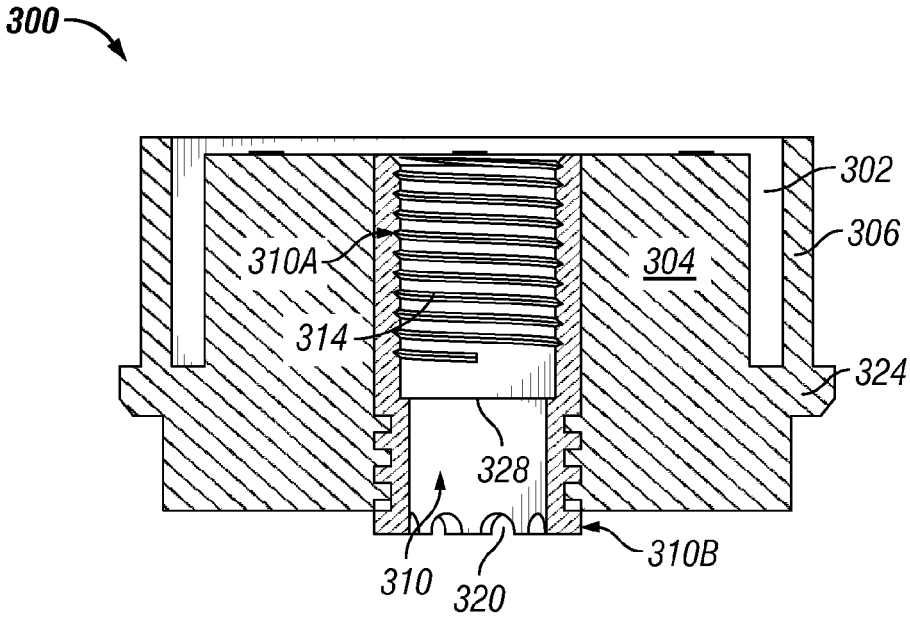
FIG. 3B is a side cross-sectional view of the bushing of FIG. 3A, according to an exemplary embodiment.
Figure 7:
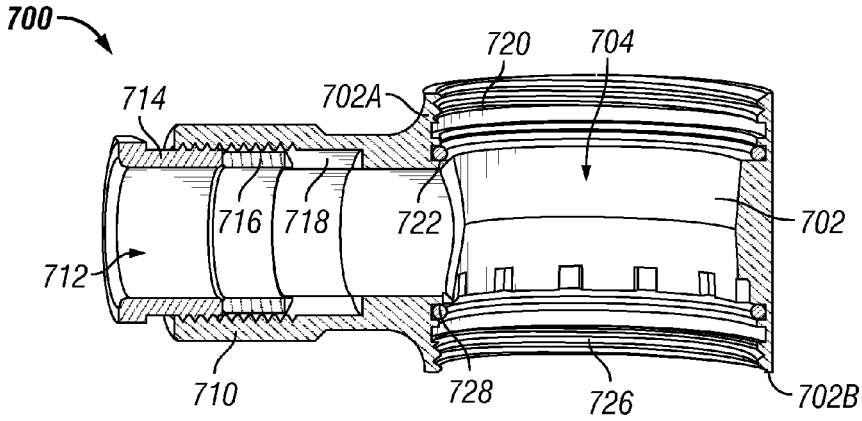
FIG. 7 is a side cross-sectional view of a connector shell, according to an exemplary embodiment.
Figure 10A:
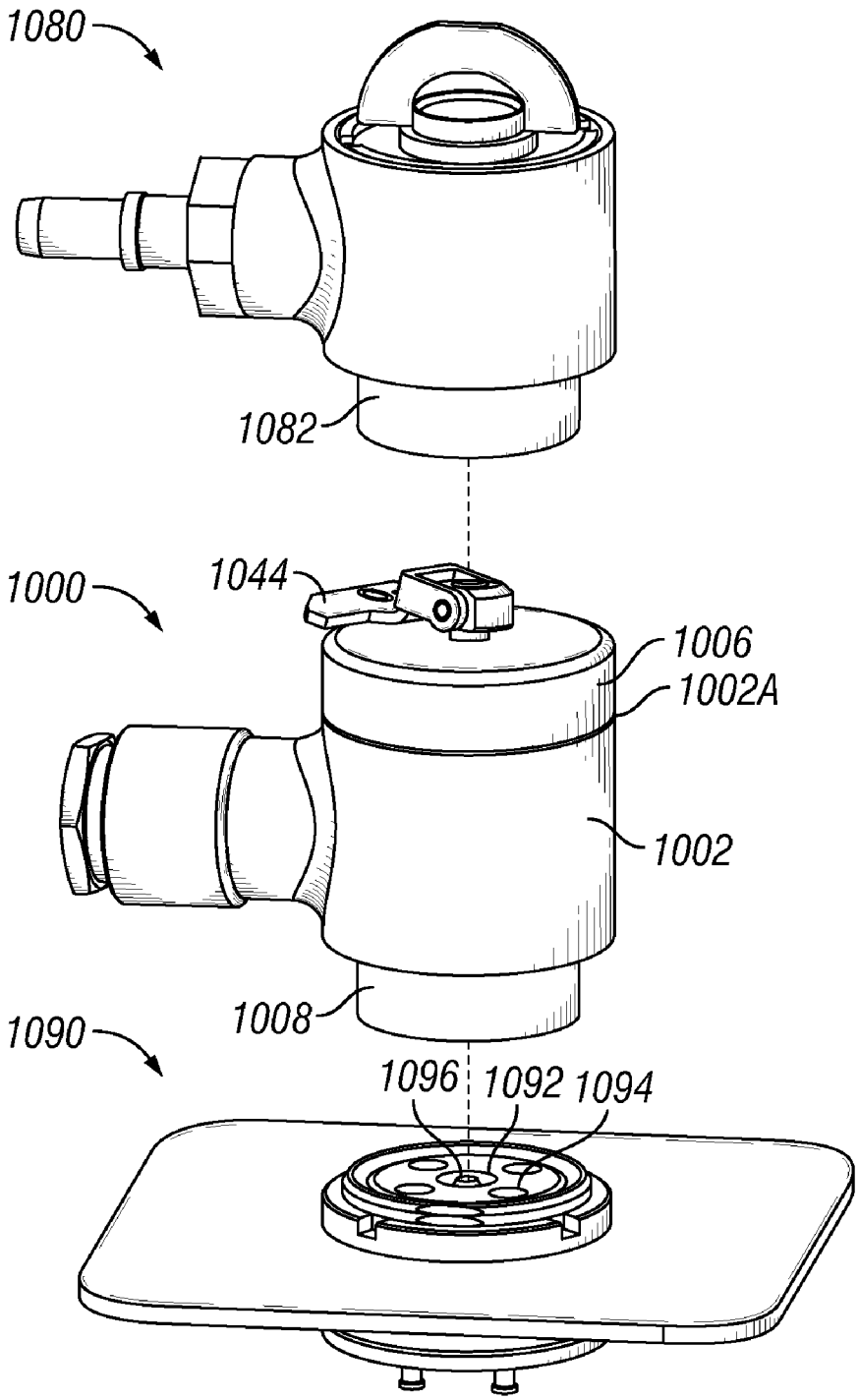
FIG. 10A is a perspective view of a primary connector, a secondary connector, and a power source, in a disassembled state, according to an exemplary embodiment.
Figure 10B:
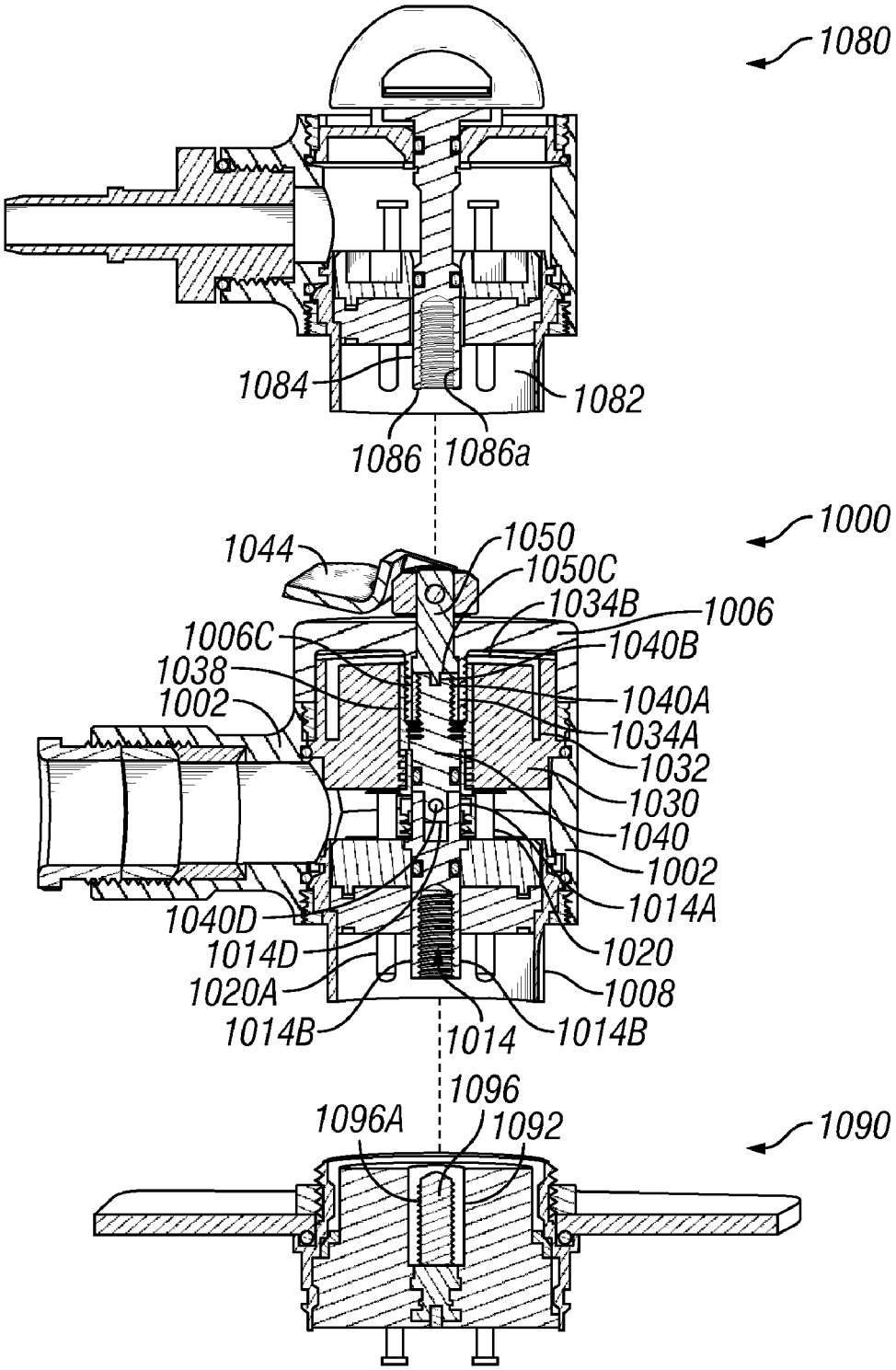
FIG. 10B is a side cross-sectional view of the primary connector, the secondary connector, and the power source of FIG. 10A, in a disassembled state, according to an exemplary embodiment.

FIG. 3A is a perspective view of a molded-in bushing 300, and FIG. 3B is a side cross-sectional view of the bushing 300, according to an exemplary embodiment. In certain embodiments, the bushing 300 is constructed from passivated, 303 stainless steel. The bushing 300 includes a cylindrical recess 302 defining a center portion 304. The recess 302 is positioned between an outer wall 306 of the bushing 300 and the center portion 304. The recess 302 is configured to receive a nosepiece 1082 of a secondary connector 1080 (FIGS. 10A-10B). The center portion 304 includes a central aperture 310 and four pin apertures 312 positioned about the central aperture 310. The central aperture 310 includes female threads 314 on an interior of an upper portion 310*a* thereof. The central aperture 310 is configured to mate with threads 208 on the projection 206 of the cap 200 (FIG. 2). The bushing 300 also includes multiple semi-circular grooves 320 spaced about a lower end 310*b* of the central aperture 310. The grooves 320 are configured to receive a pin 430 that protrudes from a draw screw 400 (FIG. 4). The bushing 300 also includes a protrusion 324 that engages a ledge 722 within a connector shell 700 (FIG. 7). The bushing 300 further includes a ledge 328 that engages a protrusion 414 on the draw screw 400 (FIG. 4).

Figure 4:
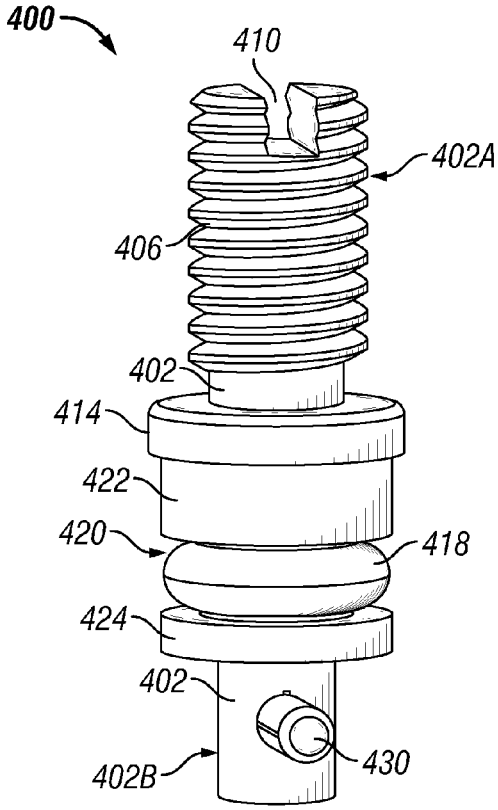
FIG. 4 is a perspective view of a draw screw, according to an exemplary embodiment.

FIG. 4 is a perspective view of a draw screw 400, according to an exemplary embodiment. In certain exemplary embodiments, the draw screw 400 is constructed from passivated, 303 stainless steel. The draw screw 400 includes a central shaft 402 having an upper portion 402*a* and a lower portion 402*b*. The upper portion 402*a* includes male threads 406 configured to mate with female threads 1086*a* of a stud 1086 in a secondary connector 1080 (FIGS. 10A-10D). The upper portion 402 also includes a groove 410 configured to mate with the protrusion 226*c* of the draw screw engagement pin 226 (FIG. 2). The draw screw 400 also includes a protrusion 414 at a position below the threads 406. The protrusion 414 is configured to engage the ledge 328 of the bushing 300 (FIG. 3). Below the protrusion 414, the draw screw 400 includes an o-ring 418 positioned within in a groove 420 created by two cylindrical protrusions 422, 424. The o-ring 418 provides an environmental seal between the central aperture 310 and the draw screw 400. The o-ring 418 provides an environmental barrier against water leak or moisture migration into the termination area of the connector, thus preventing the connector from short circuiting and/or corrosion and failure. The draw screw 400 also includes a cylindrical pin 430 that protrudes from two sides of the lower portion 402*b* of the shaft 402. The pin 430 is configured to engage the grooves 320 of the bushing 300 (FIG. 3).

Figure 5:
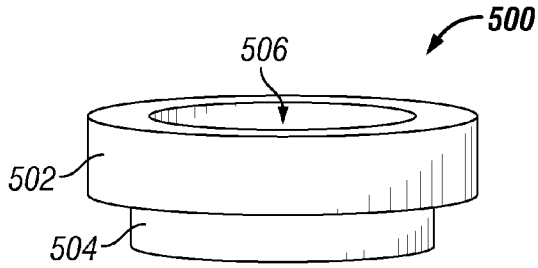
FIG. 5 is a perspective view of a nylon spacer, according to an exemplary embodiment.
Figure 6:
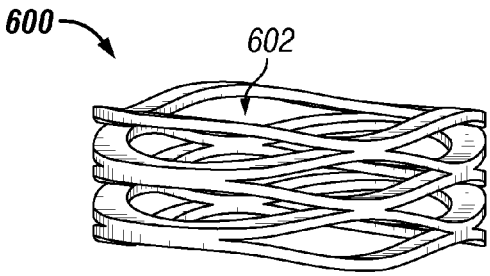
FIG. 6 is a perspective view of a spring member, according to an exemplary embodiment.

FIG. 5 is a perspective view of a nylon spacer 500, according to an exemplary embodiment. The spacer 500 includes a cylindrical upper portion 502 and a cylindrical lower portion 504. The upper portion 502 has a diameter greater than a diameter of the lower portion 504, and greater than or equal to a diameter of a spring member 600 (FIG. 6). The lower portion 504 is sized to fit within an opening 602 in the spring member 600 (FIG. 6). The upper portion 502 and the lower portion 504 include an opening 506 extending therethrough. The opening 506 is configured to receive an upper portion 802 of a stud 800 (FIG. 8). In certain embodiments, the spacer 500 is constructed from nylon, type 66. In certain alternative embodiments, the spacer 500 is constructed from any durable, non-conductive material.

FIG. 6 is a perspective view of a spring member 600, according to an exemplary embodiment. In certain exemplary embodiments, the spring member 600 is a compressible cylindrical spring. In certain embodiments, the spring member 600 is a coil spring or a compressive elastomeric member. In certain embodiments, the spring member 600 is constructed from beryllium copper, stainless steel, music wire, neoprene (compressible elastomeric), and the like. The spring member 600 includes an opening 602 sized to receive the lower portion 504 of the spacer 500 (FIG. 5) and an upper portion 802 of a stud 800 (FIG. 8).

FIG. 7 is a side cross-sectional view of a connector shell 700, according to an exemplary embodiment. The connector shell 700 includes a cylindrical housing portion 702 having an upper end 702*a*, a lower end 702*b*, and an opening 704 therethrough. The connector shell 700 also includes an extension 710 extending orthogonally from the housing portion 702. The extension 710 includes an opening 712 extending therethrough. The opening 712 of the extension 710 is in communication with the opening 704 of the housing portion 702. The extension 710 is configured to receive an end of a cable (not shown) therein. The extension 710 includes a nut 714, a ferrule 716, and a rubber grommet 718 defining the opening 712 therein. The cable is retained by positioning the cable through the opening 712, and threading the nut 714 into the ferrule 716, thereby compressing the grommet 718. Compression of the grommet 718 provides a clamping force on the cable, thereby retaining the cable within the shell 700. The clamping force also provides the required strain relief necessary to secure the cable therein.

The connector shell 700 also includes female threads 720 in the upper end 702*a* of the housing portion 702. The threads 720 are configured to mate with male threads 154 of a spanner nut 154 (FIG. 1D) that secures the bushing 300 (FIG. 3) within the connector shell 700. Below the threads 720, the housing portion 702 includes a ledge 722 configured to engage the protrusion 324 of the bushing 300 (FIG. 3). The connector shell 700 also includes female threads 726 in the lower end 702*b* of the housing portion 702. The threads 726 are configured to mate with male threads 170*a* of a spanner nut 170 (FIG. 1D) that secures a nosepiece 900 (FIGS. 9A-9B) within the connector shell 700. Above the threads 726, the housing portion 702 includes a ledge 728 configured to engage a protrusion 922 of a nosepiece 900 (FIGS. 9A-9B).

Figure 8A:
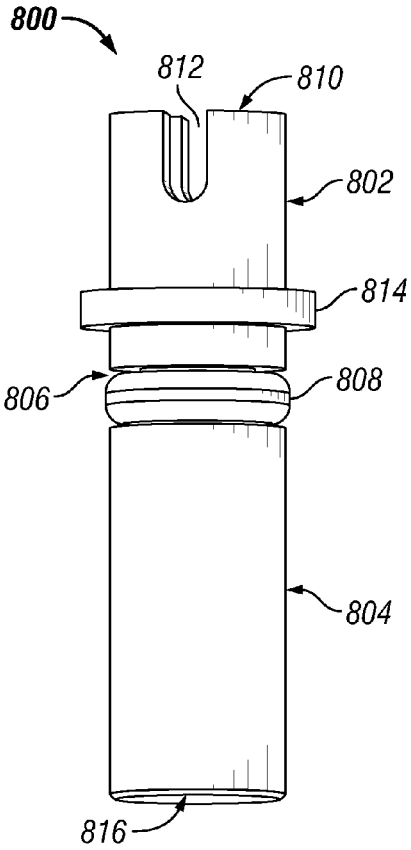
FIG. 8A is a perspective view of a cylindrical stud, according to an exemplary embodiment.
Figure 8B:
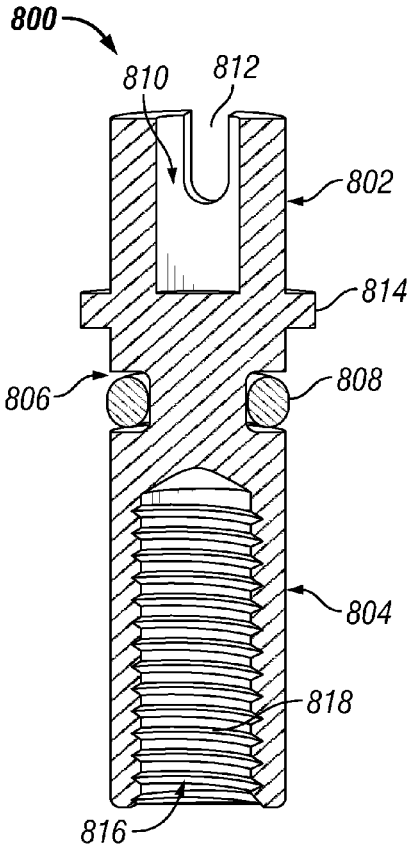
FIG. 8B is a side-cross-sectional view of the stud of FIG. 8A, according to an exemplary embodiment.

FIG. 8A is a perspective view of a cylindrical stud 800, and FIG. 8B is a side-cross-sectional view of the stud 800, according to an exemplary embodiment. In certain exemplary embodiments, the stud 800 is constructed from passivated, 303 stainless steel. The stud 114 includes an upper portion 802 and a lower portion 804. The upper portion 802 and the lower portion 804 are separated by a groove 806. The groove 806 is configured to receive an o-ring 808 therein. The o-ring 808 provides an environmental seal between the stud 800 and an insert assembly 902 (FIG. 9A). The upper portion 802 of the stud 800 includes a cavity 810 therein. The cavity 810 is configured to receive the lower portion 402*b* of the draw screw 400 (FIG. 4) therein. The upper portion 802 also includes two slots 812 configured to receive the pin 430 of the draw screw 400. The upper portion 802 further includes a protrusion 814 configured to engage a ledge 918 in a nosepiece 900 (FIG. 9B). The lower portion 804 of the stud 800 includes a cavity 816 having female threads 818 therein. The cavity 816 is configured to receive a screw 1096 (FIGS. 10A-10D) when coupled to a power source 1090 (FIGS. 10A-10D).

Figure 9B:
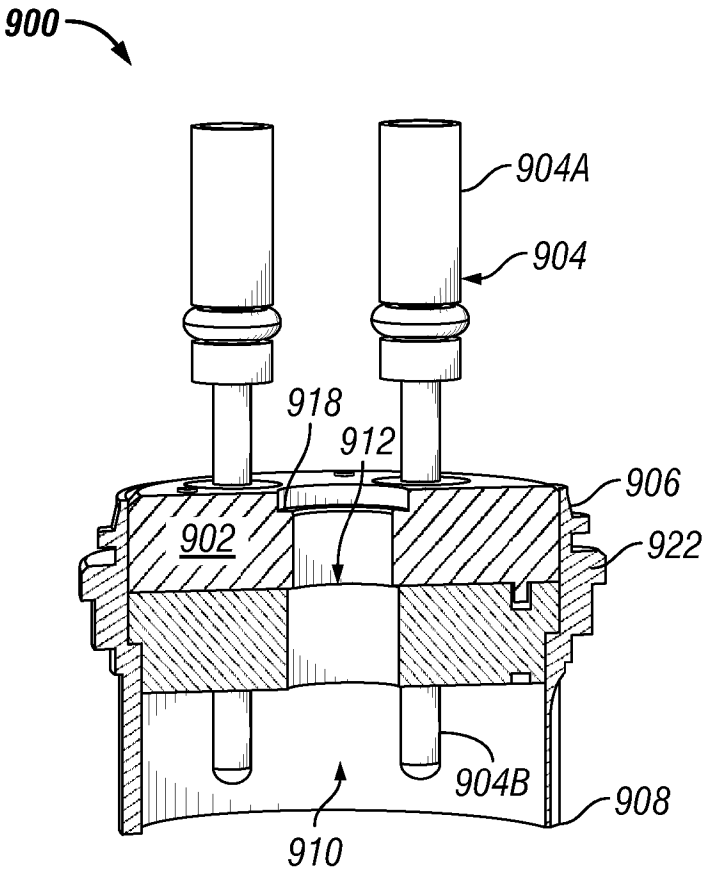
FIG. 9B is a side cross-sectional view of the nosepiece of FIG. 9A, according to an exemplary embodiment.
Figure 9A:
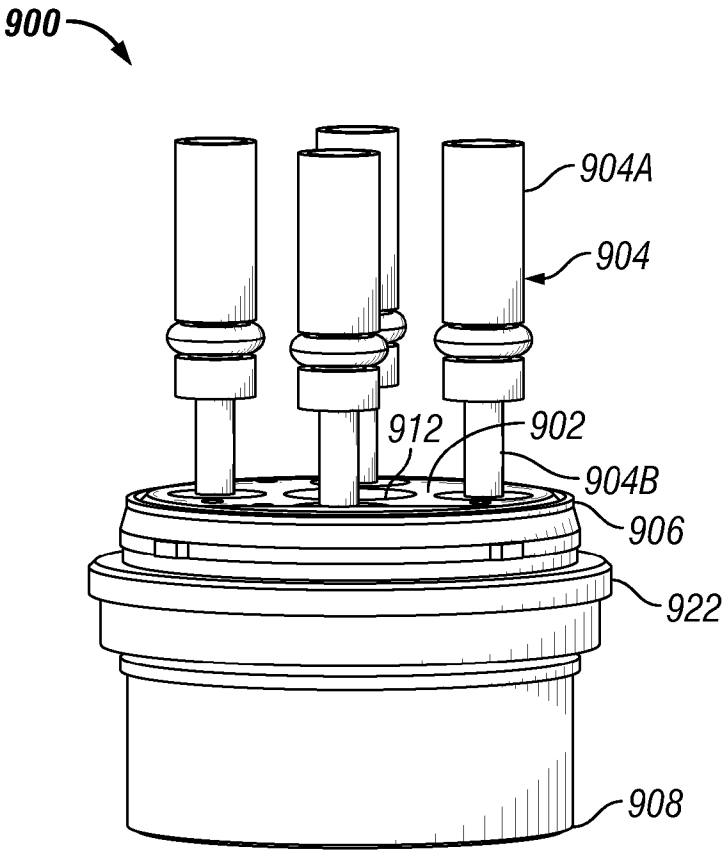
FIG. 9A is a perspective view of a nosepiece, according to an exemplary embodiment.

FIG. 9A is a perspective view of a cylindrical nosepiece 900 having an insert assembly 902 and four contact pins 904, and FIG. 9B is a side cross-sectional view of the nosepiece 900, according to an exemplary embodiment. The nosepiece 900 includes an upper end 906 and lower end 908, and a cavity 910 extending from the upper end 906 to the lower end 908. The insert assembly 902 is secured within the cavity 910 of the nosepiece 900, and is recessed away from the lower end 908. The insert assembly 902 includes a central aperture 912 and four pin apertures 914 positioned about the central aperture 912. The central aperture 912 is configured to receive the stud 800 (FIG. 8). In certain exemplary embodiments, the central aperture 912 includes a ledge 918 configured to engage the protrusion 814 in the upper portion 802 of the stud 800 (FIG. 8). The nosepiece 900 also includes a protrusion 922 that rests against the ledge 728 within the connector shell 700 (FIG. 7). Each of the four pin apertures 914 are configured to receive one of the contact pins 904. Each of the contact pins 904 includes an upper portion 904*a* and a lower portion 904*b*. The upper portion 904*a* includes female threads (not shown), and is configured to receive contact pins 1084 of a secondary connector 1080 (FIGS. 10A-10D). The upper portion 904*a* is positioned within the pin apertures 312 of the bushing 300 (FIG. 3). The lower portion 906*b* is configured to engage a power source 1090 (FIGS. 10A-10D). The lower portion 904*b* is positioned within the pin apertures 914, and extends out from the insert assembly 902 into the cavity 910 of the nosepiece 900.

Figure 10C:
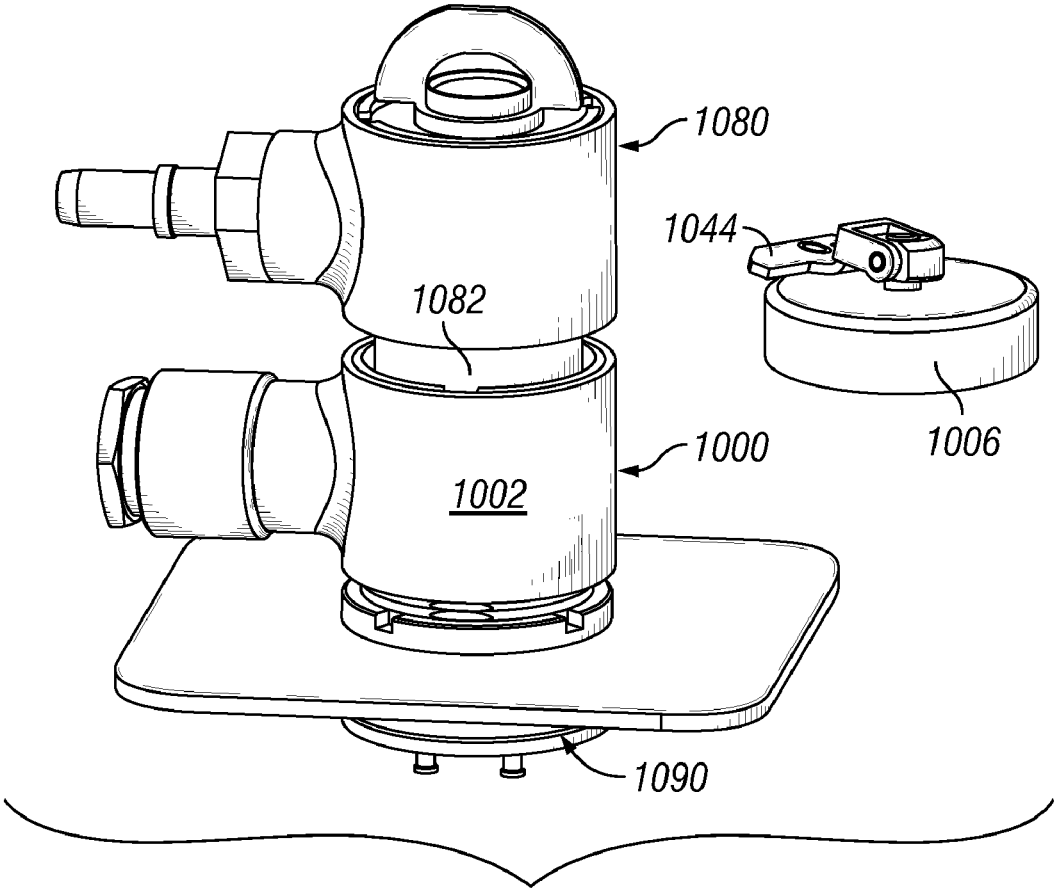
FIG. 10C is a perspective view of the primary connector, the secondary connector, and the power source of FIG. 10A, in an assembled state, according to an exemplary embodiment.
Figure 10D:
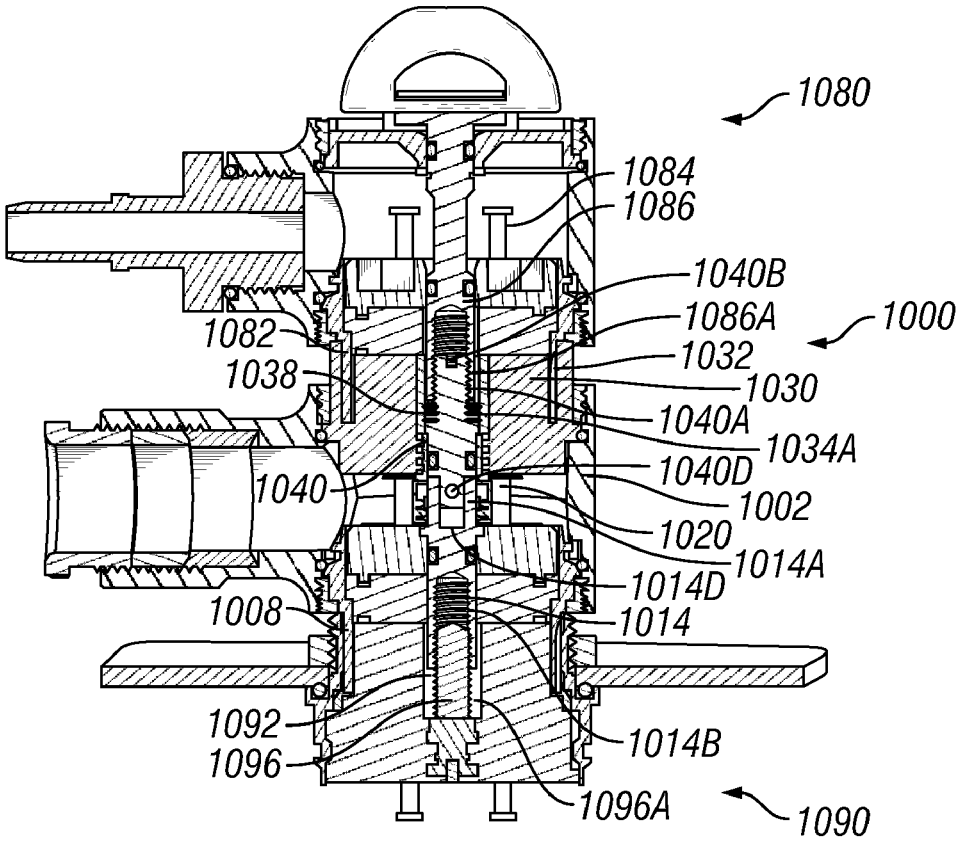
FIG. 10D is a side cross-sectional view of the primary connector, the secondary connector, and the power source of FIG. 10A, in an assembled state, according to an exemplary embodiment.

FIG. 10A is a perspective view of a primary connector 1000, a secondary connector 1080, and a power source 1090, and FIG. 10B is a side cross-sectional view of the primary connector 1000, the secondary connector 1080, and the power source 1090, prior to assembly, according to an exemplary embodiment. FIG. 10C is a perspective view of the primary connector 1000, the secondary connector 1080, and the power source 1090, and FIG. 10D is a side cross-sectional view of the primary connector 1000, the secondary connector 1080, and the power source 1090, in an assembled state, according to an exemplary embodiment. The primary connector 1000 is similar to the connector 100 (FIG. 1E). The secondary connector 1080 is a COTS and/or M55181 cable mount connector that is commercially available from Cooper Technologies Company. The power source 1090 is a M55181 panel mount connector that is commercially available from Cooper Technologies Company. The power source can be any commercially product unit that facilitates the use of the M55181 panel mount style connector. The power source 1090 can be any direct current (DC) power source. In certain embodiments, the power source 1090 is a vehicle battery supply. In alternative embodiments, the invention can also be utilized in alternating current (AC) applications. The primary connector 1000 can be coupled to the power source 1090 to supply power to a first device (not shown). The secondary connector 1082 can then be coupled to the primary connector 1000 to supply power to a second device (not shown).

The primary connector 1000 includes a connector shell 1002 housing a nosepiece 1008 and molded-in bushing 1030. The nosepiece 1008 includes a stud 1014 having two slots 1014*d* in an upper portion 1014*a*, and female threads in a lower portion 1014*b*. The nosepiece 1008 also includes a lower portion 1020*a* of contact pins 1020 extending therethrough for connecting to the power source 1090. The bushing 1030 includes a central aperture 1034*a*, four pin apertures 1034*b* positioned about the central aperture 1034*a*, and a cylindrical recess 1032 surrounding the pin apertures 1034*b*. An upper portion (not shown) of the contact pins 1020 is positioned within the pin apertures 1034*b*. The central aperture 1034*a* includes female threads 1038 on the upper end of the interior thereof, and a plurality of grooves (not shown) spaced apart about the central aperture 1034*a* on the lower end. A draw screw 1040 is positioned within the central aperture 1034*a*. The draw screw 1040 includes male threads 1040*a* and a groove 1040*b* in an upper portion, and a pin 1040*d* extending orthogonally from a lower portion.

The secondary connector 1080 includes a nosepiece 1082, four contact pins 1084 in electrical communication with a cable (not shown), and a cylindrical stud 1086 having female threads 1086*a* therein. The power source 1090 includes a central aperture 1092 and four pin apertures 1094 positioned around the central aperture 1092. A screw 1096 having male threads 1096*a* is positioned within the central aperture 1092.

Referring to FIGS. 10A and 10B, prior to assembly, a cap 1006 covers an upper end 1002*a* of the primary connector 1000. The cap 1006 is secured to the primary connector 1000 by male threads on a projection 1006*c* in mating connection with female threads 1038 in the central aperture 1034*a* of the bushing 1030. The cap 1006 includes a draw screw engagement pin 1050 having a protrusion 1050*c* engaging the groove 1040*b* in the draw screw 1040. The cap 1006 includes a handle 1044 that is coupled to the draw screw engagement pin 1050 such that the draw screw engagement pin 1050 rotates upon rotation of the handle 1044. With the cap 1006 in place, the pin 1040*d* of the draw screw 1040 is disengaged from the grooves on the bushing 1030, and positioned within the slots 1014*d* of the stud 1014.

To couple the primary connector 1000 to the secondary connector 1080 and the power source 1090, a user couples the primary connector 1000, with the cap 1006, to the power source 1090 first. The lower portion 1020*a* of each of the contact pins 1020 is positioned within the pin apertures 1094 of the power source 1090, and the lower portion 1014*b* of the stud 1014 is aligned with the screw 1096 of the power source 1090. In certain exemplary embodiments, to align the primary connector 1000 and the power source 1090 correctly, the nosepiece 1008 includes a guide (not shown) for engaging a corresponding shaped slot (not shown) in the power source 1090. The primary connector 1000 is secured to the power source 1090 by pivoting the handle 1044 so as to allow a user to grasp it, and rotating the handle 1044 in a clockwise direction. Rotation of the handle 1044 causes the draw screw engagement pin 1050 to rotate, thus causing the protrusion 1050*c* that is positioned within the groove 1040*b* of the draw screw 1040 to also rotate, which subsequently causes the draw screw 1040 to rotate. Since the pin 1040*d* of the draw screw is disengaged from the bushing 1030, and positioned within the slots 1014*d* of the stud 1014, as the draw screw 1040 rotates, the stud 1014 also rotates. Rotation of the stud 1014 allows the male threads of the screw 1096 of the power source 1090 to mate with the female threads of the lower portion 1014*b* of the stud 1014, thus locking the primary connector 1000 with the power source.

Referring now to FIGS. 10C and 10D, to secure the secondary connector 1080 to the primary connector 1000, the cap 1006 is removed by rotating the cap 1006 in a counterclockwise direction. The male threads on the projection 1006*c* of the cap 1006 disengages the female threads 1038 in the central aperture 1034*a* of the bushing 1030 upon rotation. Once the cap 1006 is removed, the pin 1040*d* of the draw screw 1040 engages the grooves on the bushing 1030. With the pin 1040*d* in the grooves, the draw screw 1040 is unable to rotate, thus preventing the stud 1014 from also rotating and accidentally disengaging from the power source 1090.

After the cap 1006 is removed, the secondary connector 1080 is positioned over the primary connector 1000 such that the nosepiece 1082 is positioned within the recess 1032 of the bushing 1030, the contact pins 1084 are aligned with the pin apertures 1034*b*, and the stud 1086 is aligned with the draw screw 1040. In certain exemplary embodiments, to align the primary connector 1000 and the secondary connector 1080 correctly, the bushing 1030 includes a guide (not shown) in the recess 1032 for engaging a corresponding shaped slot (not shown) in the nosepiece 1082 of the secondary connector 1080. The secondary connector 1080 includes a handle 1088 coupled to the stud 1086. Upon rotation of the handle 1088 in a clockwise direction, the stud 1086 also rotates such that the female threads 1086*a* therein mate with male threads 1040*a* on the draw screw 1040 and lock the secondary connector 1090 in place. As a result, two cables (not shown) may be coupled to the power source 1090 by the primary connector 1000 and the secondary cable 1090.

To remove the secondary connector 1090 from the primary connector 1000, the user simply rotates the handle 1088 in a counterclockwise direction to disengage the female threads 1086*a* of the stud 1086 from the male threads 1040*a* on the draw screw 1040. Once the secondary connector 1080 is removed, the cap 1006 can be coupled to the primary connector 1000 by rotating the cap 1006 in a clockwise direction such that male threads on the projection 1006*c* of the cap 1006 mate with the female threads 1038 in the central aperture 1034*a* of the bushing 1030. To remove the primary connector 1000 from the power source 1090, the user rotates the handle 1044 of the cap 1006 in a counterclockwise direction. Rotation of the handle 1044 causes the draw screw engagement pin 1050 to rotate, thus causing the protrusion 1050*c* that is positioned within the groove 1040*b* of the draw screw 1040 to also rotate, which subsequently causes the draw screw 1040 to rotate. Since the pin 1040*d* of the draw screw is disengaged from the bushing 1030, and positioned within the slots 1014*d* of the stud 1014, as the draw screw 1040 rotates, the stud 1014 also rotates. Rotation of the stud 1014 allows the male threads of the screw 1096 of the power source 1090 to disengage the female threads of the lower portion 1014*b* of the stud 1014, thus unlocking the primary connector 1000 from the power source.

Therefore, the present invention is well adapted to attain the ends and advantages mentioned as well as those that are inherent therein. The particular embodiments disclosed above are illustrative only, as the present invention may be modified and practiced in different but equivalent manners apparent to those having ordinary skill in the art having the benefit of the teachings herein. Having described some exemplary embodiments of the present invention, it is believed that the use of alternate connector shell, insert assembly, bushing, and nosepiece configurations is within the purview of those having ordinary skill in the art. Additionally, while the present application generally illustrates cylindrical insert assemblies, connector shells, bushings, contact pins, and nosepieces, it is understood that a number of other non-circular configurations may be used. In addition, while it is taught that the bushing includes a draw screw opening positioned in a center thereof, a symmetric pattern of coupling screws could be utilized in a rectangular shell configuration. Furthermore, multiple primary connectors may be coupled together, as limited to current availability and requirements of the system to be powered.

While numerous changes may be made by those having ordinary skill in the art, such changes are encompassed within the spirit of this invention as defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. The terms in the claims have their plain, ordinary meaning unless otherwise explicitly and clearly defined by the patentee.

What is claimed is:

1. A connector comprising:

a shell having a first cavity and a second cavity;

a bushing positioned within the first cavity of the shell, the bushing having a draw screw opening and at least one primary upper pin aperture;

at least one primary contact pin having an upper portion and a lower portion, wherein the upper portion of the least one primary contact pin is positioned within the at least one primary upper pin aperture, wherein the upper portion includes a cavity for receiving secondary contact pins;

a draw screw positioned within the draw screw opening of the bushing; and a stud positioned adjacent to the draw screw, the stud forming a cavity therein for receiving a coupling mechanism, wherein the draw screw is configured to rotatively move the stud and draw the coupling mechanism further into the cavity.

2. The connector of claim 1, wherein the draw screw comprises a locking pin.

3. The connector of claim 2, wherein the bushing comprises a plurality of grooves for receiving the locking pin, wherein the draw screw is fixed within the bushing when the locking pin is positioned within at least one of the grooves.

4. The connector of claim 1, further comprising a nosepiece positioned within the first cavity of the shell apart from the bushing, the nosepiece having an insert assembly positioned therein.

5. The connector of claim 4, wherein the insert assembly comprises a stud aperture and at least one primary lower pin aperture.

6. The connector of claim 5, wherein the lower portion of the at least one primary contact pin is positioned in the at least one primary lower pin aperture.

7. The connector of claim 5, further comprising a stud positioned within the stud aperture.

8. The connector of claim 7, wherein the stud comprises an upper stud portion, wherein the upper stud portion comprises at least one slot for receiving the locking pin.

9. The connector of claim 8, wherein the draw screw and the stud are rotatable within the connector when the locking pin is positioned within the at least one slot in the stud.

10. The connector of claim 8, further comprising a spring member positioned around the upper stud portion, wherein the spring member biases the locking pin into at least one of the grooves.

11. The connector of claim 7, wherein the stud comprises a lower stud portion, wherein the lower stud portion comprises a threaded opening.

12. The connector of claim 1, further comprising a cover removably coupled to an end of the shell having the bushing therein.

13. The connector of claim 12, wherein the cover comprises a draw screw engagement pin.

14. The connector of claim 13, wherein the draw screw engagement pin engages the draw screw and allows rotation of the draw screw within the bushing.

15. The connector of claim 1, further comprising a cable positioned in the second cavity, wherein the cable is in electrical contact with at least one primary contact pin.

16. A connector system comprising:

a shell housing having a first cavity and a second cavity, the first cavity having an upper shell portion and a lower shell portion;

an electrical cable disposed within the second cavity;

a bushing positioned within the upper shell portion of the first cavity, the bushing having a draw screw opening, a plurality of primary upper pin apertures, and a means for engaging a draw screw;

the draw screw positioned in the draw screw opening of the bushing and having a locking means, an insert assembly positioned within the lower shell portion of the first cavity, the insert assembly having a stud aperture and a plurality of primary lower pin apertures;

a stud positioned in the stud aperture, the stud having an upper stud portion and a lower stud portion, the upper stud portion having a receiving means for receiving the locking means;

a plurality of primary contact pins in electrical contact with the cable, each primary contact pin having an upper portion and a lower portion, wherein the upper portion of each primary contact pin is positioned within a primary upper pin aperture, wherein the upper portion includes a pin cavity for receiving a secondary contact pin, wherein the lower portion of each primary contact pin extends through a primary lower pin aperture; and a spring member disposed around the upper stud portion, wherein the spring member biases the locking means towards the means for engaging a draw screw when in an extended state, and wherein the spring member biases the locking means towards the receiving means when in a compressed state.

17. The connector of claim 16, wherein the locking means is a locking pin, and the means for engaging a draw screw comprises a plurality of grooves, wherein the draw screw is fixed within the bushing when the locking pin is positioned within at least one of the grooves.

18. The connector of claim 17, wherein the receiving means comprises at least one slot for receiving the locking pin, wherein the draw screw and the stud are rotatable within the connector system when the pin is positioned within the at least one slot in the stud.

19. The connector of claim 16, further comprising a cover removably coupled to the shell housing adjacent the first cavity.

20. The connector of claim 19, wherein the cover comprises a draw screw engagement pin, wherein the draw screw engagement pin engages the draw screw and compresses the spring member, and allows rotation of the draw screw within the bushing.

* * * * *